US005562169A

United States Patent [19]

Barrow

[11] Patent Number: 5,562,169

[45] Date of Patent: Oct. 8, 1996

[54] SONIC DRILLING METHOD AND APPARATUS

[76] Inventor: Jeffrey Barrow, 640 College St., Woodland, Calif. 95695

[21] Appl. No.: 445,798

[22] Filed: May 22, 1995

Related U.S. Application Data

[63] Continuation-in-part of Ser. No. 300,251, Sep. 2, 1994, Pat. No. 5,417,290.

[51] Int. Cl.[6] ..... E21B 7/00

[52] U.S. Cl. ..... 175/56; 175/58; 173/49

[58] Field of Search ..... 175/55, 56, 22, 175/105, 58; 173/49

[56] References Cited

U.S. PATENT DOCUMENTS

| | | | |
|---|---|---|---|
| 3,633,688 | 1/1972 | Bodine | 175/55 |
| 4,271,915 | 6/1981 | Bodine | 175/56 |
| 4,366,988 | 1/1983 | Bodine | 175/55 X |
| 4,403,665 | 9/1983 | Bodine | 175/55 |
| 4,471,838 | 9/1984 | Bodine | 166/249 |
| 4,487,554 | 12/1984 | Bodine | 417/241 |
| 4,527,637 | 7/1985 | Bodine | 175/55 |
| 4,548,281 | 10/1985 | Bodine | 175/55 |
| 4,553,443 | 11/1985 | Rossfelder et al. | 173/49 X |
| 4,603,748 | 8/1986 | Rossfelder et al. | 175/55 X |
| 4,615,400 | 10/1986 | Bodine | 175/55 |
| 4,693,326 | 9/1987 | Bodine | 175/55 |
| 4,702,315 | 10/1987 | Bodine | 166/249 |
| 4,817,712 | 4/1989 | Bodine | 166/249 |
| 4,836,299 | 6/1989 | Bodine | 175/22 |
| 4,848,486 | 7/1989 | Bodine | 175/55 |
| 5,027,908 | 7/1991 | Roussy | 173/49 |
| 5,086,854 | 2/1992 | Roussy | 175/320 |
| 5,417,290 | 5/1995 | Barrow | 175/56 |

*Primary Examiner*—Frank Tsay
*Attorney, Agent, or Firm*—Limbach & Limbach L.L.P.

[57] ABSTRACT

In combination with resonant sonic earth drilling components, and for particular use in retrieving a core sample in a core barrel seated against an internal shoulder in a sonically driven drill bit, a resilient axial loading device not only urges the bottom of the core barrel into continuous contact with the seat but also cushions the core barrel from the sonic energy in the drill bit, thereby minimizing damage to the core sample.

18 Claims, 5 Drawing Sheets

SONIC DRILLING METHOD AND APPARATUS

CROSS REFERENCE TO RELATED APPLICATION

The present application is a continuation in part of U.S. patent application Ser. No. 08/300,251, filed Sep. 21 issued as U.S. Pat. No. 5,417,290 on May 23, 1995.

BACKGROUND OF THE INVENTION

The invention relates generally to methods and apparatus for drilling and coring earth formations and, more particularly, to improvements in the coring system disclosed in Bodine U.S. Pat. No. 4,836,299 for Sonic Method and Apparatus for Installing Monitor Wells for the Surveillance and Control of Earth Contamination. The disclosure in U.S. Pat. No. 4,836,299 (the '299 patent) is incorporated herein by reference.

SUMMARY OF THE INVENTION

Although the Bodine system provides numerous advantages over previous arrangements for penetrating the earth and altering surface and sub-surface earth with minimal environmental disturbance, the manner in which the core barrel is isolated from the transmitted sonic energy in the drill pipe of the Bodine system leaves room for improvement. The '299 patent depicts (in FIGS. 4 and 4A) and describes (at column 4) compliant isolator ring members 35*a* and 35*b* positioned at the opposite ends of the inner casing member 34 (core barrel) to isolate the inner casing member 34 from the driven outer casing member 31 (drill pipe), so that the core material 50 is not significantly changed. It has been found that under certain conditions, additional cushioning is desirable.

It is an object of the present invention to provide means for effectively cushioning the core barrel against the transmitted sonic energy, thereby minimizing damage to the core sample.

It is another object of the invention to hold the core barrel resiliently but securely against the bit face seat by imposing a resilient axial load on the core barrel as core sampling proceeds.

It is still another object of the invention to facilitate the taking of continuous core samples of near in situ quality in a safe and efficient manner.

Other objects, together with the foregoing, are attained in the embodiments described in the accompanying description and shown in the attached sheets of drawing of the various figures.

DETAILED DESCRIPTION OF THE PREFERRED EMBODIMENTS

The resonant sonic drilling method uses a drill head which has a mechanism for vibrating a drill pipe. A preferred mechanism for vibrating the drill pipe has an oscillator adapted to transmit sinusoidal pressure waves through a steel drill pipe to create a cutting action at the bit face. The drill head is preferably hydraulically powered but may be powered in any other manner. The pressure waves are created by two counter-rotating, offset balance roller weights each having an eccentric axis located in the oscillator of the sonic drill head.

The drill head is designed to operate at frequencies close to the natural frequency of the steel drill column thereby causing the column to vibrate elastically along its longitudinal axis. In the resonant condition, the drill column stores and releases energy and generates large forces between the drill bit and the earth formation. Operating frequencies exceeding 150 Hz and forces ranging up to 1112 KN (250,000 lbs-force) per cycle are reliably generated by ResonantSonics$^{SM}$ drill heads developed by Water Development Corporation, a company related to Water Development Technologies, Inc. There are several ways to perform the sonic drilling technique, some being more effective than others.

Where core sampling for analysis is to be made, it is important that the core, when removed from the drill pipe assembly, be undamaged. In accordance with the present invention, an approach which yields an especially high quality core uses a steel rod string in combination with an axial loading device. This arrangement not only isolates the core barrel from the sonic action but prevents retraction of the core barrel from the drill bit shoe as sonic coring occurs.

Figure 1:
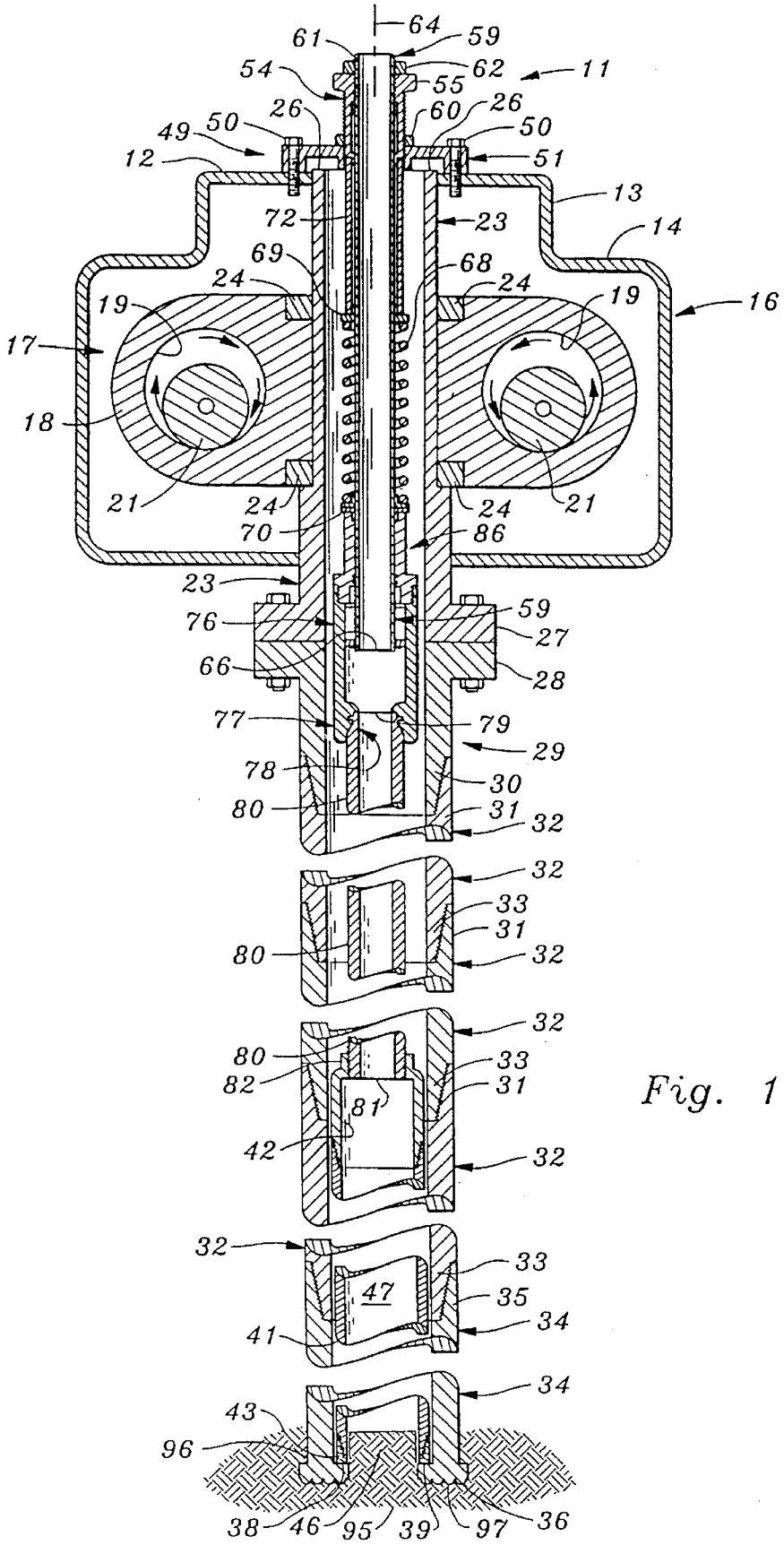
FIG. 1 is a stylized elevational view, largely in median longitudinal cross section, of a preferred embodiment of the axial loading device core system installed on a sonic head.

Referring to FIG. 1, an axial loading device 11 is secured to the top 12 of an air spring housing 13 mounted centrally on the outer case 14 of a resonant sonic drill head 16. The construction and operation of the resonant sonic drill head 16 is well known. Disposed within the outer case 14 of the sonic head 16 is an oscillator 17 including a body 18 having formed therein a pair of orbital races 19 within which a respective pair of eccentric rollers 21 are caused to revolve at high speed in counter-rotating directions, as indicated by the directional arrows.

The energy impulses created by the oscillator 17 are transmitted to a center column 23 extending through the oscillator. A pair of thrust bearings 24 enhances the operation of the oscillator-center column coupling. The center column 23 extends from an upper end 26, projecting upwardly beyond the top 12 of the air spring housing 13, to a lower end characterized by a flange 27 for bolted connection to the flange 28 of a casing adapter 29, or casing sub, which in turn, terminates in a tapered threaded pin 30 adapted to engage with a threaded box 31 at the upper end of a section of drill pipe 32. The lower end of the section of drill pipe 32 is provided with a threaded pin 33 similar to the pin 30 at the bottom of the sub 29, and, in like manner, is adapted to engage with the box 31 at the upper end of another section of drill pipe 32. Each section of drill pipe 32 is commonly ten feet in length, sufficient sections being employed to reach the depth required for coring.

At the lower end of the bottom section of drill pipe 32 is mounted a drill bit 34 with the drill pipe 32 and the drill bit 34 being designated by the term drill string 40. The upper end of the drill bit 34 includes a box 35 to engage the threaded pin 33 of the adjacent drill pipe 32 section. The lower end of the drill bit 34 terminates in an enlarged bit face 36 at the lower end of an enlarged bit shoe 37. The drill bit face 36 can assume various different forms depending on the type of soil, gravel, rock, large boulders or other formation to be sampled. Although it is preferred to provide the sonic drill head 16, any other mechanical or electro-mechanical vibrating mechanism may be used to impart vibrations in the drill pipe 32.

Figure 3:
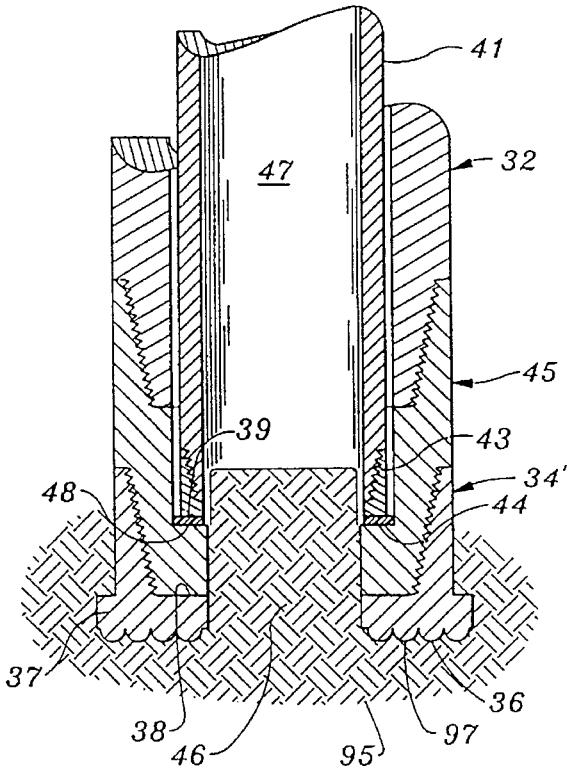
FIG. 3 is a fragmentary, stylized, median longitudinal cross-sectional view, to a slightly enlarged scale, illustrating a modified arrangement for seating the lower end of the core barrel.

The enlarged bit shoe 37 at the lower end of the drill bit 34 is formed with an internal shoulder 38 which provides a seat for the substantially congruent bottom end 39 of a core barrel 41. In order to reduce wear on the internal shoulder 38 of the bit shoe 37, and to afford cushioning, a compliant ring 44 can be interposed between the seat 38 and the lower end 39 of the core barrel 41. FIG. 3 illustrates such a ring on a variant configuration. The ring 44 can be of a durable elastomeric material, for example.

The variant configuration shown in FIG. 3 comprises a threaded sub 45 interposed between the bottom end of the drill pipe 32 and a modified form of drill bit 34'. The sub 45 includes an internal shoulder 48 which provides a seat for the bottom end 39 of the core barrel 41 comparable to the internal shoulder 38 of the drill bit 34 shown in FIG. 1. The FIG. 3 variation prevents wear from taking place on the shoulder seat 38 and, as shown, a compliant ring 44 serves to cushion and reduce wear on the interfaces of the seat 48 provided by the sub 45 and the lower end 39 of the core barrel 41.

The core barrel 41 is preferably of the longitudinally split type in order to facilitate core sample extraction with least damage to the sample. During use, the two halves of the core barrel 41 are held firmly together by a cap 42 and a shoe 43 threaded on the respective top and bottom of the core barrel 41. Although a split barrel is preferred, any other type of core barrel may also be used with the present invention.

Referring again to FIG. 1, the bottom of the shoe 43 seats on the internal shoulder 38 of the drill bit 34. The inside diameter of the core barrel 41 iS slightly larger than the inside diameter of the drill bit face so that a core sample 46 emerging from the sonically driven bit face 36 smoothly enters the central sample chamber 47 of the core barrel 41.

By coupling the resonant sonic drill head to the drill pipe, the cutting action developed at the bit face yields a continuous core of formation material moving into the core barrel 41. Inherent in the transfer of core material from the drill bit to the core barrel 41 is the tendency of the outer wall of the core sample 46 to frictionally engage the encompassing wall of the core barrel chamber 47 and thereby lift the bottom of the core barrel 41 off the seat 38. This tendency can be alleviated to some extent by the provision of a core barrel liner (not shown) having a low coefficient of friction, such as Lexan, and by making the inside diameter of the core barrel 41 somewhat larger than that of the inside diameter of the bit face 36, as previously mentioned and as shown.

Referring again to FIG. 1, the cap 42 is shown in the form of a barrel in which the top portion of the core sample is sometimes located at the end of the sampling period. Since this top portion of the core sample is often in a damaged condition it is usually discarded or sloughed off, hence the name slough barrel.

The axial loading device 11 of the present invention is a positive step in the direction of overcoming the tendency of the core barrel 41 to become separated from the internal shoulder 38 in the drill bit 34 as coring proceeds. The axial loading device 11, as appears in FIG. 1, is encapsulated, for the most part, within the center column 23 which, as previously stated, partakes of the sonic vibration generated by the oscillator 17 inside the sonic drill head case 14. The case 14 as well as the air spring housing 13 are rigid, or fixed, in the sense that they do not sonically vibrate. Thus, by mounting the axial loading device 11 on the housing 13, the device of the invention is also isolated.

In other words, the axial loading device 11 does not sonically vibrate even though the center column 23 surrounding the device carries and transmits the resonant sonic energy impulses from the oscillator 17 to the drill pipe 32, thence to the drill bit 34, the drill pipe 32 and drill bit 34 being collectively termed drill string, for convenience.

Providing the mounting of the axial loading device 11 to the drill head 16, as by fastenings 50, is a thrust cap 51 comprising a circular in plan steel plate having a central opening defined by a cylindrical threaded wall 52. Adapted threadably to engage the threaded interior wall 52 is the threaded exterior wall 53 of a generally cylindrical member termed a core barrel position adjustment sleeve 54 surmounted by a flange 55. Approximately axially, or longitudinally, coextensive with the flange 55, a portion 56 of the interior wall 57 of the sleeve 54 is threaded, the balance of the interior wall 57 being smooth and having a slightly larger diameter to accommodate, with some clearance, the smooth exterior wall portion 58 of a base tube 59. The outer wall on the uppermost end portion 61 of the base tube 59 is threaded to engage the internal threaded portion 56 of the sleeve 54 and to receive a base tube lock nut 62.

As best appears in FIG. 1, the axial loading device 11 is radially symmetrical, for the most part, about an axis 64 which is shown as being vertical in the present disclosure. It should be noted, however, that in field use, slant drilling is well within the capabilities of the structure disclosed.

Although not limited thereto in actual practice, the base tube 59 terminates at a lower end 66 in the vicinity of the casing adapter 29, or casing sub. In performing the dual function of (a) maintaining the bottom end 39 of the core barrel 41 in juxtaposition to the internal shoulder 38 in the drill bit 34, or to the shoulder 48 of an interposed sub 45, and (b) cushioning the core barrel 41 from the destructive effects of sonic vibration on the core sample 46 within the core barrel 41, the present device utilizes resilient means, such as a helical compression spring 68, as shown.

The helical compression spring 68 is interposed between an L-shaped-in-section upper spring washer 69 slidably disposed on the base tube 59 and a T-shaped in section lower spring washer 70, also slidably disposed on the base tube 59. The longitudinal axial placement of the upper spring washer 69 is determined by the length of an outer tube 72 seated at its upper end on a shoulder 74 formed in the lower end of the core barrel position adjustment sleeve 54 and seated at its lower end on the adjacent shoulder of the upper spring washer 69.

The longitudinal axial placement of the lower spring washer 70 is governed by the instantaneous position of two elongated members coaxially disposed relative to the base tube 59. The lower of the two members is termed a core rod connector 76 since, at its bottom end it includes a fitting 77 adapted for quick coupling to a mating fitting 78 on the upper end 79 of a core rod 80 which extends axially downwardly where the lower end 81 of the core rod 80 is detachably connected either to the upper end 82 of the core barrel 41 or to the top section of one or more axially arranged intermediate core rods 80 ultimately terminating in a detachable connection to the core barrel 41.

The upper end of the core rod connector 76 is supported on the lower end 85 of a connector guide 86 slidably mounted on the base tube 59. The upper end of the connector guide 84 abuts the adjacent surfaces of the washer 70. Downward travel of the connector guide 86 under spring urgency is limited by abutment with a bearing washer 88 positioned by an external lock ring 89, or retainer ring, snapped into a groove adjacent the lowermost end 66 of the base tube 59, the bearing washer 88 interfering with a bushing on the lower end 85 of the guide 86 when the spring 68 is in extended position. Upward travel of the core rod connector 76 is limited by the presence of the same bearing washer 88 which interferes with a shoulder 91 located adjacent the upper end of the fitting 77 when the spring is in compressed position.

Thus, the maximum longitudinal travel of the combined connector guide 86 and core rod connector 76 (and the resulting maximum extent of compression and extension of the spring 68) is determined by the distance between the bushing on the lower end 85 of the guide 86 and the shoulder 91 on the core rod connector 76. A plurality of o-rings 93 are strategically located on the combined members 76 and 86 to afford sealing and improved operation of the combined members.

Downward force is imposed by the bottom end of the spring 68 (acting through the combined members 76 and 86) as the core rods 80 are installed and the bottom one of the core rods is connected to the core barrel 41, urging the bottom end 39 of the core barrel 41 against the seat 38 provided by interior shoulder of the drill bit 34. Reaction, in an upward direction, against the bottom end of the spring 68, occurs as sonic energy is imposed on the drill bit 34 by the drill pipe 32 to which the drill bit is attached.

The spring force opposing the reactive force is dependent upon the extent to which the spring 68 is compressed. In order to achieve optimum performance, compression or expansion of the spring is effected by adjustment of the components of the device conveniently located above the thrust cap.

In other words, assuming that drilling has proceeded to the point where the drill bit face 36 has entered a stratum 95, or bed, to be sampled and the core sample 46, having been separated by the sonic energy present at the bit face, begins to enter the core barrel 41, as in FIG. 1, there is a tendency for the core sample 46 to urge the core barrel upward off the seat 38, as previously stated. If the downward force provided by the spring 68 is inadequate, the upward urgency imposed by the entering core sample 46 could result in unseating the bottom end 39 of the core barrel 41 from the internal shoulder 38 of the bit face, with consequent potential for damage to the core sample.

If, on the contrary, the spring 68 is overly compressed and exerts too great a downward force, an unwanted amount of sonic energy will be transferred from the drill bit face to the bottom end of the core barrel, with possible resultant damage to the core sample.

When the spring urgency is in the optimum range, sufficient downward force is imposed on the core barrel to overcome the lifting force caused by the entering core sample but not enough to create a rigid system with its attendant problems.

With the spring force in optimum range (usually about mid-range) an experienced operator can, by listening to the sound of the coring operation, determine whether the core barrel is being lifted off the seat 38 since the sound of the impact between the shoe 43 and the seat 38 of the drill bit 34 ceases. By reducing coring speed, the constant spring force will restore the contact between the shoe 43 and the seat 38 and the sound resumes.

In order to adjust the axial loading device 11, either to decrease or increase the spring force on the core barrel, the base tube lock nut 62 and the core barrel position adjustment sleeve lock nut 60 are loosened. This enables the operator to shift the core barrel axially so that with the entire string assembled, all slack is removed and the bottom of the core barrel is seated on the internal shoulder 38 of the bit. At this juncture, the core barrel position adjustment lock nut 60 is tightened into face to face engagement with the top surface of the thrust cap.

Next, the base tube 59 is rotated about its own axis 64, the threaded engagement between the base tube's 59 externally threaded portion 61 and the adjustment sleeve's internally threaded portion 56 causing axial movement of the base tube 59 with resultant corresponding movement of the retainer ring 89 and attendant bearing washer 88.

With all slack out of the entire string, and with the spring 68 in maximum compressed condition caused by the bearing washer 88 engaging and pressing upwardly on the lower end 85 of the connector guide 86, the system is substantially rigid and sonic vibration is likely to be transferred from the drill bit to the core barrel, with deleterious consequences to the core sample. In this situation, the base tube 59 would be rotated in a direction such that the base tube is translated in an axially downward direction, lowering the bearing washer 88 and allowing the connector guide 86 to descend, resulting in expansion of the spring 68 and consequent reduction in spring force urging the core barrel downwardly against the seat 38 in the drill bit.

Upon reaching optimum position, the base tube 59 is locked by tightening the base tube lock nut 62 against the flange 55 of the core barrel position adjustment sleeve 54. The spring 68 exerts a resilient force to the core barrel thereby forcing the core barrel toward the shoulder of the drill bit. The term "resilient force" as used herein refers to a force which varies according to the displacement of the core barrel. The relationship between the resilient force and displacement of the core barrel is not limited to linear force/displacement relationships, such as with the spring 68, but encompasses any force/displacement relationship which provides an increasing force with increasing displacement of the core barrel. When the core barrel displaces toward the uphole end of the drill pipe, the spring 68 is compressed and exerts a larger force on the core barrel. The resilient force on the core barrel can also be provided with any other mechanism including a tension spring, cantilevered tabs, an elastomeric member, a resilient latch, or a pressurized fluid driven device such as hydraulic or pneumatic rams. As will be described below in connection with FIGS. 4–6, another preferred embodiment of the invention provides the resilient force using a pressurized gas or fluid.

Resonant sonic drilling can then proceed in core runs of any length as dictated by sampling requirements. For example, the core runs may be one foot, five foot, ten foot, twenty foot, or longer. Once the desired amount of core is in the core barrel, the core rods 80, also termed inner drill rods, and the core barrel 41 are removed in sections from the borehole 96 and the core is retrieved. The outer drill pipe 32 remains in place to support the borehole 96 while the core barrel 41 is removed.

Owing to the high forces developed by the resonant sonic drill head 16 and the externally flush nature of the drill pipe 32, formation material displaced by the cutting face 36 of the drill bit 34 is forced either into the surrounding borehole wall 96 or into the core barrel chamber 47, with the result that no cuttings are generated in the drilling operation. In order to enhance core quality, little, if any, rotation of the drill pipe 32 or core rods 80 is used in this type of operation.

Figure 2:
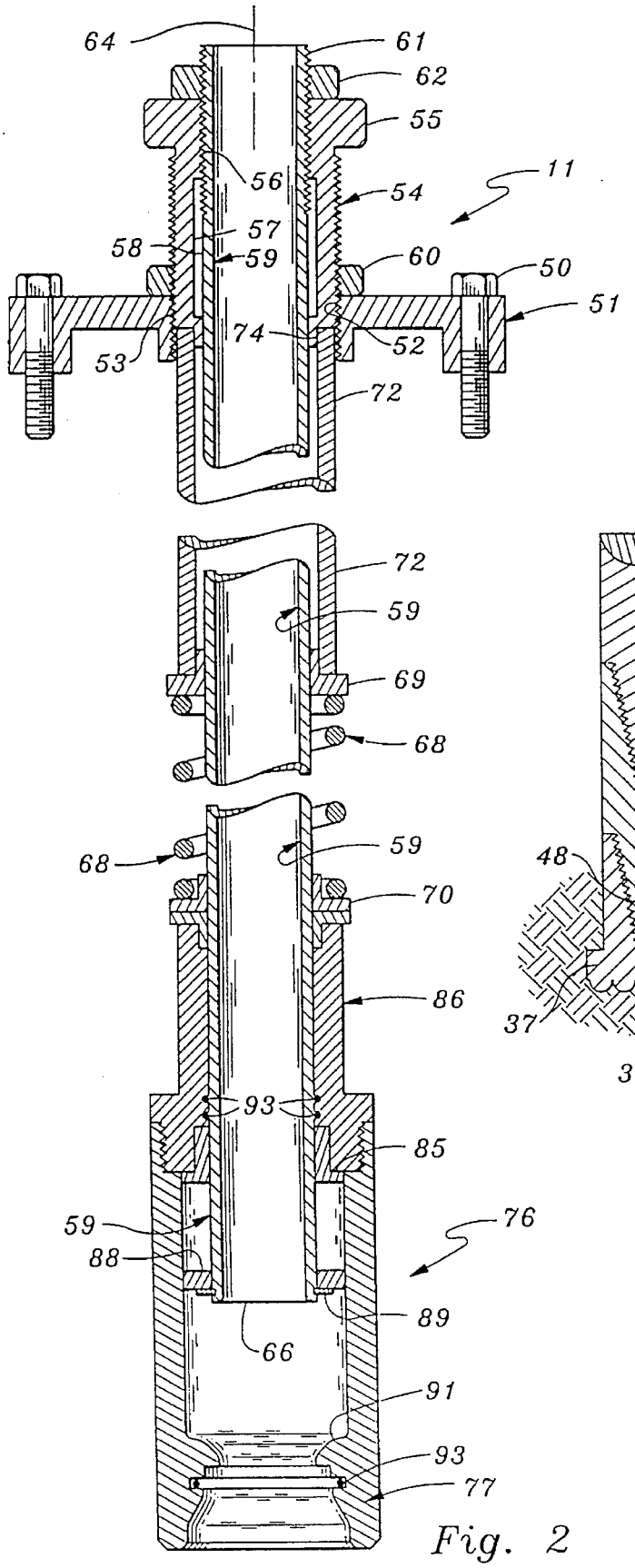
FIG. 2 is a stylized view comparable to FIG. 1, but to an enlarged scale, illustrating structural details of the device.
Figure 4:
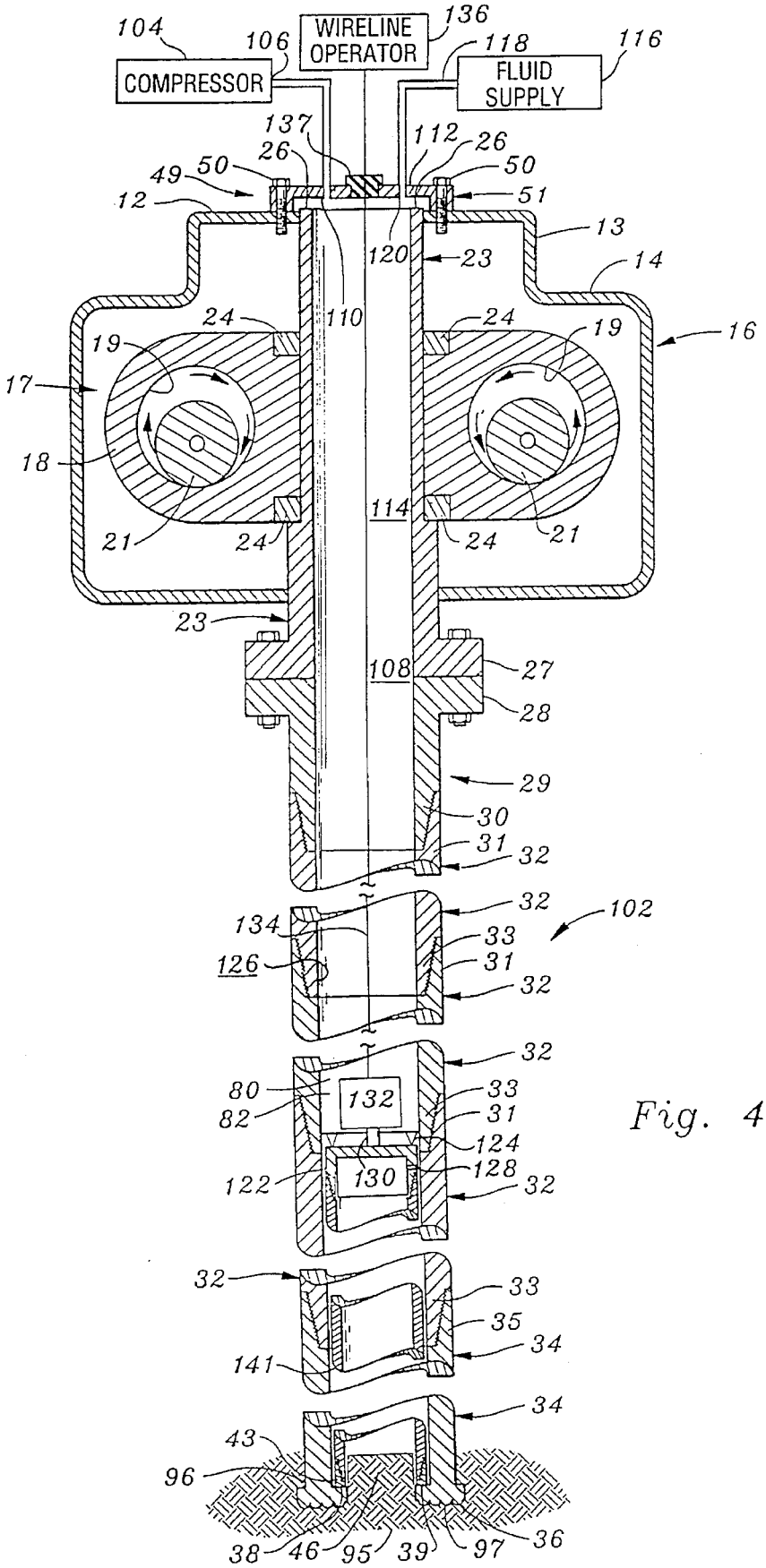
FIG. 4 is a cross-sectional view of a second preferred embodiment of the sonic drilling apparatus.

Referring to FIG. 4, a second preferred sonic drilling apparatus 102 of the present invention is shown. The same reference numbers are used for the same structural features shown in the preferred embodiments of FIGS. 1–3 and discussion of the common structural features is omitted. The sonic drilling apparatus 102 includes a compressor 104 having an outlet 106 coupled to an interior 108 of the drill pipe 32 for pressurizing a gas in the drill pipe 32. A gas connection 110 extends through a plate 112 coupled to the outer casing 14 of the sonic head 16.

The compressor 104 pressurizes the gas, preferably air, in the drill pipe 32 for cushioning vibrations of a core barrel 141. The gas is contained in a gas space 114 defined between the drill pipe 32, core barrel 141 and plate 112.

A fluid source 116 is also coupled to the interior of the drill pipe 32 for delivering a fluid, preferably water, to the interior of the drill pipe 32 via a fluid line 118 and a fluid connection 120 at the plate 112. Use of the fluid source 116 is described below in connection with the preferred methods of sonic drilling of the present invention.

An o-ring 122 and a chevron seal 124 engage the core barrel 141 and drill pipe to prevent the gas and fluid from escaping between the core barrel 141 and drill pipe 32. The chevron seal 124 is preferably configured to be forced against an interior wall 126 of the drill pipe 32 when the gas space 114 is pressurized. The core barrel 141 abuts the shoulder 38 of the drill bit 34, however, a resilient member, as described above, may also be provided between the core barrel 141 and drill bit 34 to further cushion the core barrel 141.

The core barrel 141 has a displaced air port 128 for exhausting air displaced by material entering the core barrel 141. A check valve (not shown) may be coupled to the displaced air port 128 to prevent flow of gas and fluid into the core barrel 141 through the displaced air port 128 as is known to those having skill in the art.

The core barrel 141 also preferably includes a wireline connector 130 which is configured to engage a wireline device 132 having a cable 134. A wireline operator 136 controls the wireline device 132 in a manner known to those having skill in the art. The wireline device 132 advantageously permits quick installation and retrieval of the core barrel 141. When rod or pipe sections are used, on the other hand, the rod or pipe connections must be broken which increases the time required to lower and retrieve the core barrel 141 when working at large depths. Although it is preferred to use the wireline device 132, any other mechanism may be used to install and retrieve the core barrel 141. A removable seal 137 is provided to seal the space between the cable 134 and plate 112 so that the wireline device 132 does not have to be disconnected after the core barrel 141 has been lowered into the drill pipe 32. Alternatively, the wireline device 132 may be removed during drilling and re-engaged with the wireline connector 130 when drilling is completed.

A method of sonic drilling is now described in connection with the preferred embodiment of Figure 4. The core barrel 141 is lowered into the drill pipe 32 until the core barrel 141 abuts the shoulder 38 of the drill bit 34. The compressor 104 is activated so that the gas pressure increases in the gas space 114. The sonic drilling head 16 is then activated so that the drill pipe 32 vibrates and begins to penetrate the formation. As the drill pipe 32 advances through the formation, material from the formation enters the core barrel 141 and air within the interior of the core barrel 141 is displaced through the displaced air port 128. The pressurized gas in the drill pipe 32 cushions vibrations of the core barrel 141. The force on the core barrel 141 may be adjusted by simply adjusting the gas pressure in the gas space 114. The gas in the gas space 114 acts as the resilient force on the core barrel 141 so that when the core barrel 141 displaces upwardly, the gas space 114 decreases and the pressure force on the core barrel 141 increases. Although it is preferred to permit the gas pressure in the gas space 114 to increase when the core barrel 141 displaces upwardly, the pressure of the gas in the gas space 114 may also manually adjusted or maintained at a constant pressure.

Figure 5:
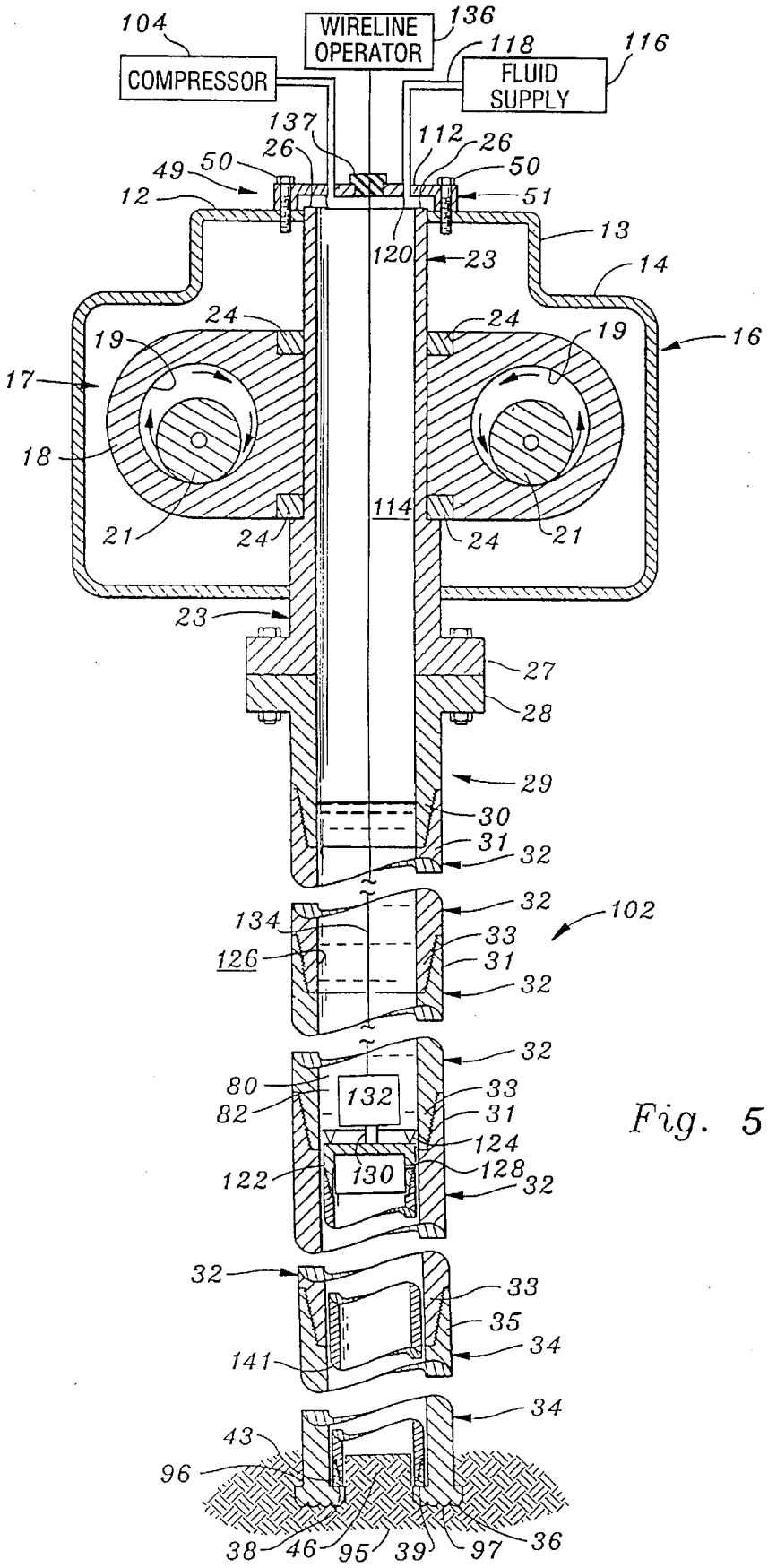
FIG. 5 is a cross-sectional view of the second preferred embodiment of FIG. 4 with fluid in the drill pipe.

Another preferred method of sonic drilling is described in connection with FIG. 5 which depicts the sonic drilling apparatus 102. A fluid 117 is introduced into the interior of the drill pipe 32 from the fluid source 116 so that the fluid 117 accumulates in the interior of the drill pipe 32 to a desired level. The compressor 104 is then activated to pressurize the gas in the gas space 114. The fluid head in the interior of the drill pipe 32 and the gas pressure in the gas space 114 together exert a downward force on the core barrel 141. The force on the core barrel 141 can be varied by varying the pressure of the gas or by varying the fluid level in the drill pipe 32.

As described above, the gas in the gas space 114 may be used to provide the resilient force against the core barrel 141 by permitting the pressure in the gas space to increase when the core barrel displaces upwardly in the drill pipe 32. If a hard formation is encountered, the core barrel 141 may separate from the shoulder 38 of the drill bit 34. As the core barrel 141 displaces upwardly in the drill pipe, the gas space decreases thereby increasing the gas pressure in the drill pipe 32° Although it is preferred to permit the pressure in the drill pipe 32 to increase when the core barrel 141 displaces upwardly in the drill pipe 32, the pressure of the gas in the drill pipe 32 may also be kept constant so that a constant pressure force is applied to the core barrel 141.

The volume of the gas space 114 affects the resilient behavior of the pressurized gas and it may be desirable to vary the volume of the gas space 114 for drilling through different types of formations. With a small gas space 114, relatively small displacements of the core barrel 141 will increase the pressure of the gas quickly. Conversely, when a large gas space 114 is provided, small displacements of the core barrel 141 will not produce significant changes in gas pressure. In effect, varying the volume of the gas space 114 varies, in a sense, the spring constant of the resilient force applied by the gas.

Thus, the force on the core barrel 141 can be adjusted by adjusting the fluid level in the drill pipe 32 and/or adjusting the gas pressure in the gas space 114. The resilient nature of the force applied to the core barrel 141 can be adjusted by changing the volume of the gas space 114 so that the spring constant of the gas can be varied.

Although the volume of the gas space 114 can be varied by simply varying the amount of water in the drill pipe 32, the gas space 114 can also be varied by introducing space-filling objects into the interior of the drill pipe 32. Such objects preferably float on the fluid in the drill pipe 32 so that after drilling is completed the objects may be simply flushed out of the drill pipe. An advantage of using such space-filling objects would be that the hydraulic load on the core barrel 141 would not be altered substantially as occurs when simply changing the level of water in the drill pipe 32. Alternatively, a piston-like member can be introduced into the drill pipe 32 to reduce the gas space 114 by reducing the space between the piston-like member and the fluid in the drill pipe 32.

Figure 6:
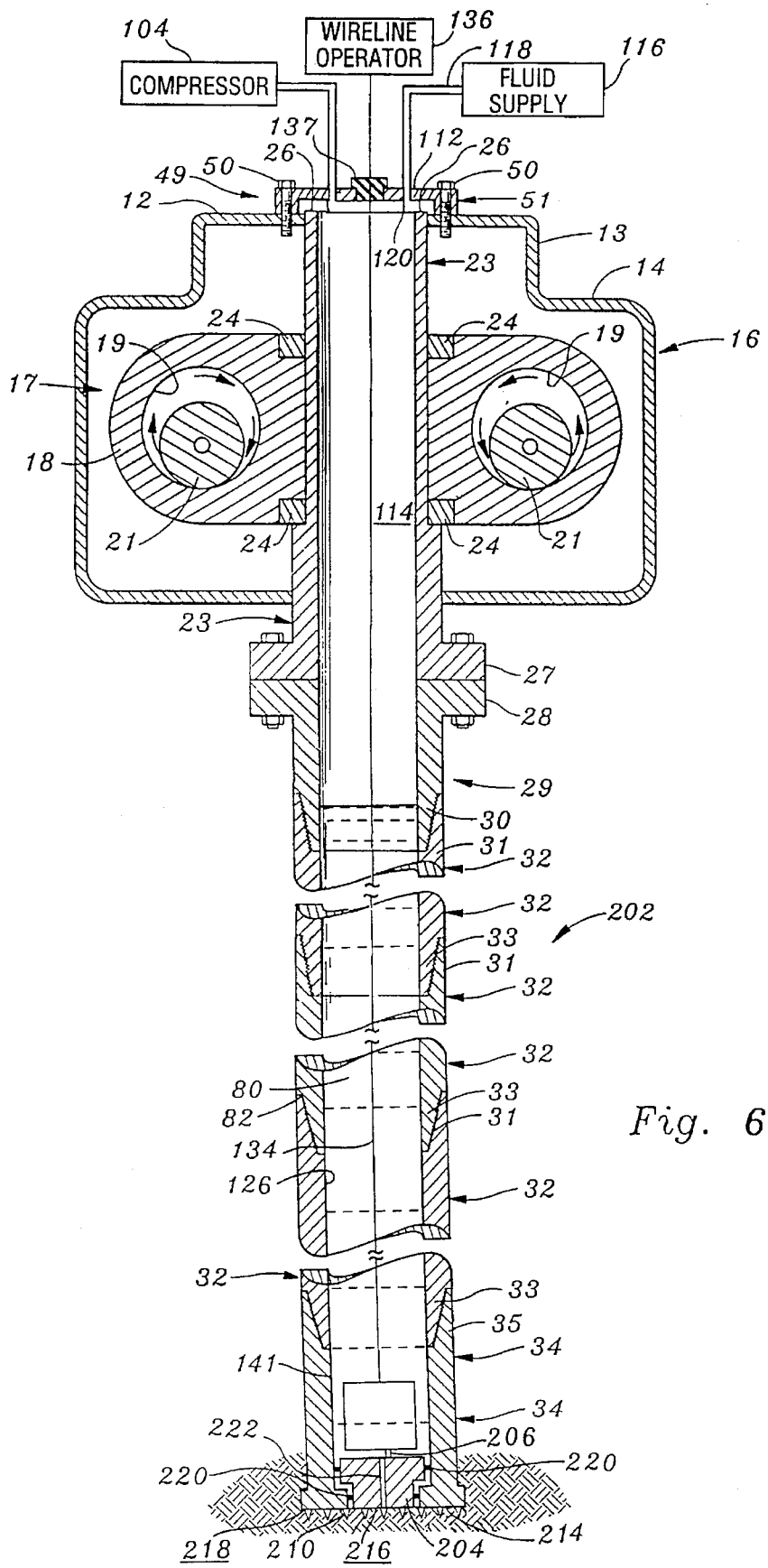
FIG. 6 is a cross-sectional view of a third preferred embodiment of the sonic drilling apparatus having a plug at the downhole end of the drill pipe.

Referring to FIG. 6, a third preferred embodiment of a sonic drilling apparatus 202 is shown. The same reference numbers are used for the same structural features shown in the preferred embodiments of FIGS. 1–4 and discussion of the common structural features is omitted. The third preferred sonic drilling apparatus 202 includes a plug 204 rather than the core barrel 141 described in the previous embodiments of FIGS. 1–4. The plug 204 is used to drill through a formation when a core sample of the subsurface is not desired.

The plug 204 has a wireline connection 206 which is configured to engage a wireline device 208 as is known to those having skill in the art. The compressor 104 supplies pressurized gas, preferably air, and the fluid source 116 supplies fluid, preferably water, to the interior of the drill pipe 32 as described above in connection with the second preferred embodiment 102.

The plug 204 has a cylindrical sealing portion 210 which seals an opening 212 in the drill bit 34. The sealing portion 210 preferably includes teeth 214 to cut through the subsurface but may include any other features or may be a substantially flat plate. The sealing portion 210 of the plug 204 has a downhole face 216 which is substantially flush with a downhole face 218 of the drill bit 34, however, the downhole face 216 may also be recessed or extend further than the downhole face 218 of the drill bit 34. 0-rings 220 are provided for sealing the space between the plug 204 and the drill pipe 32.

A fluid port 222 extends completely through the plug 204 for supplying fluid or gas to the downhole face of the drill bit 34 and plug 204. As explained above, an advantage of sonic drilling is that cuttings are minimized, and even eliminated altogether, since the cuttings are reabsorbed into the formation. It has been found that providing fluid, or pressurized gas, at the downhole face 218 of the drill bit 34 facilitates reabsorption of the cuttings into the formation. Fluid or gas passing through the fluid port 222 serves this purpose. Although it is preferred to provide the fluid port, the fluid port may be dispensed with in certain formations where reabsorption of the cuttings occurs readily.

It is preferred to provide a single fluid port 222, although any number may be provided, since it has been observed that when a number of fluid ports 222 are provided a backflow can occur which eventually blocks the fluid ports 222. With a single fluid port 222, the likelihood of backflow and clogging is reduced.

Another preferred method of sonic drilling is now described in connection with the preferred embodiment of FIG. 6. Fluid is introduced into the interior of the drill pipe 32 from the fluid source 116 so that fluid accumulates in the drill pipe 32. The compressor 104 is then activated to pressurize the gas in a gas space 114. The fluid in the drill pipe 32 and the gas pressure in the gas space 114 together exert a downward force on the plug 204. The downward force on the plug 204 and the resilient nature of the force exerted on the plug 204 can be varied in the manner described above in connection with the previously described preferred sonic drilling method. Furthermore, the plug may be coupled to any other resilient member described above without departing from the scope of the invention. As drilling progresses, fluid is supplied to the interior of the drill pipe 32 to make up for fluid losses through the fluid port 222.

After drilling through the formation to a desired depth, the plug 204 can be removed using the wireline operator 136 in a manner known to those having skill in the art. If a core sample is desired, the core barrel 141 can be lowered into the drill pipe 32 and a core sample can be collected in the manner previously described.

The action of the ResonantSonics$^{SM}$ drill system in achieving penetration varies with the type of subterranean formation and is a result of impact forces that cause displacement, shearing and fracturing actions. In some earth formations, in order to provide a "fresh" rock surface to the drill bit, continuous rotation of the drill steel is superimposed upon the vibrational action. The structure required to effect rotation is neither shown nor described herein since sonic heads developed by Water Development Technologies, Inc. afford this capability. Furthermore, one of ordinary skill in the art could readily provide a rotating mechanism for the sonic head described herein. Referring again to FIGS. 1–3, in certain types of drilling, the operation is improved by the use of tungsten carbide buttons 97 embedded at strategic locations in the face 36 of the drill bit 34.

Each of the drilling actions, displacement, shearing and fracturing, results in a core of formation material moving into the resonating drill column and thence into the core barrel, as penetration progresses. The cored material retrieved from the core barrel, as previously discussed, will have suffered minimal damage owing to the resilient nature of the axial loading device shown and described.

Modification and variation can be made to the disclosed embodiments without departing from the subject of the invention as defined by the following claims. The methods set forth in the claims recited below have been described in conjunction with the preferred embodiments of the sonic drilling device but may be accomplished using any other apparatus as well. Furthermore, the scope of the invention as it pertains to drilling and environmental sampling is developed only as an example of one particular use for the invention. The method and apparatus of the present invention may be used to remove material for any reason and may also be used to obtain samples for any other purpose such as oil, gas and geothermal exploration.

What is claimed is:

1. A sonic drilling apparatus, comprising:

a drill pipe;

a sonic drilling head, the drill pipe being coupled to the sonic drilling head and the sonic drilling head having means for vibrating the drill pipe;

a core barrel for receiving material from a formation, the core barrel being at least partially disposed within the drill pipe;

means for applying a resilient force to the core barrel; and means for adjusting the resilient force applied to the core barrel.

2. The sonic drilling apparatus of claim 1, wherein:

the adjusting means includes a compressor having an outlet coupled to an interior of the drill pipe for pressurizing a gas in the drill pipe.

3. The sonic drilling apparatus of claim 1, wherein:

the core barrel includes a seal which engages the drill pipe.

4. The sonic drilling apparatus of claim 1, wherein:

the core barrel includes a wireline connection configured to engage a wireline device.

5. A method of sonic drilling, comprising the steps of:

providing a drill pipe, a core barrel, and a sonic head, the sonic head having means for inducing vibrations in the drill pipe for drilling through a subsurface, and the core barrel being at least partially positioned within the drill pipe;

exerting a resilient force on the core barrel;

activating the sonic head so that vibrations are induced in the drill pipe;

adjusting the resilient force; and advancing the drill pipe in the subsurface during the activating step so that material in the subsurface enters the core barrel.

6. The method of sonic drilling of claim 5, wherein:

the providing step is carried out with the drill pipe having a drill bit coupled thereto at a downhole end; and the drill bit has a shoulder configured to engage the core barrel.

7. The method of sonic drilling of claim 5, wherein:

the adjusting step is carried out with a compressor having an outlet coupled to an interior of the drill pipe for pressurizing a gas in the drill pipe.

8. A sonic drilling apparatus, comprising:

a drill pipe;

a sonic drilling head having a casing, the drill pipe being coupled to the sonic drilling head and the sonic drilling head having means for vibrating the drill pipe;

a core barrel for receiving material from a formation, the core barrel being at least partially disposed within the drill pipe; and a resilient member disposed between the core barrel and casing for dampening vibrations of the drill pipe.

9. The sonic drilling apparatus of claim 8, further comprising:

means for adjusting a force applied by the resilient member to the core barrel.

10. The sonic drilling apparatus of claim 8, further comprising:

a displacement limiting device coupled to the core barrel and the casing, the displacement limiting device limiting displacements of the core barrel.

11. A sonic drilling apparatus, comprising:

a drill pipe having a drill bit attached thereto at a downhole end, the drill bit having an opening leading to a hollow interior of the drill pipe;

a sonic drilling head, the drill pipe being coupled to the sonic drilling head and the sonic drilling head having means for vibrating the drill pipe;

a plug having a sealing portion which at least partially covers the opening in the drill bit; and means for applying a resilient force to the plug.

12. The sonic drilling apparatus of claim 11, further comprising:

means for adjusting the resilient force applied to the plug.

13. The sonic drilling apparatus of claim 12, wherein:

the resilient force adjusting means includes a compressor having an outlet coupled to an interior of the drill pipe for pressurizing a gas in the drill pipe.

14. The sonic drilling apparatus of claim 11, wherein:

the plug includes a wireline connection configured to engage a wireline device.

15. The sonic drilling apparatus of claim 11, wherein:

the plug includes at least one fluid port extending completely through the plug.

16. A sonic drilling apparatus, comprising:

a drill pipe having a drill bit attached thereto at a downhole end, the drill bit having an opening;

a sonic drilling head, the drill pipe being coupled to the sonic drilling head and the sonic drilling head having means for vibrating the drill pipe; and a plug having a sealing portion which at least partially covers the opening in the drill bit, the plug having only one fluid port extending through the plug.

17. A sonic drilling apparatus, comprising:

a drill pipe having a drill bit attached thereto at a downhole end, the drill bit having an opening;

a sonic drilling head, the drill pipe being coupled to the sonic drilling head and the sonic drilling head having means for vibrating the drill pipe;

a plug at least partially disposed within the drill pipe, the plug at least partially closing the opening in the drill bit, the plug having at least one fluid port extending through the plug;

means for introducing a fluid into the interior of the drill pipe, the fluid in the interior of the drill pipe being in communication with the at least one fluid port; and means for pressurizing a gas contained within the drill pipe.

18. A method of sonic drilling, comprising the steps of:

providing a plug, a sonic head, a drill bit, and a drill pipe having an interior, the drill bit being attached to the drill pipe and having an opening at a downhole end, the plug at least partially covering the opening and having at least one fluid port passing therethrough, the sonic head having means for inducing vibrations in the drill pipe;

introducing a fluid into the interior of the drill pipe;

pressurizing a gas contained in the interior of the drill pipe;

activating the sonic head so that the vibrations are induced in the drill pipe; and advancing the drill pipe in the subsurface during the activating step so that material in the subsurface enters the core barrel.

* * * * *